US007069616B2

(12) United States Patent
Watkins

(10) Patent No.: US 7,069,616 B2
(45) Date of Patent: Jul. 4, 2006

(54) SCRAPER

(76) Inventor: Murray Gordon Watkins, 2/29A Montgomery Crescent, Upper Hutt (NZ)

( * ) Notice: Subject to any disclaimer, the term of this patent is extended or adjusted under 35 U.S.C. 154(b) by 0 days.

(21) Appl. No.: 10/443,918

(22) Filed: May 23, 2003

(65) Prior Publication Data

US 2004/0231086 A1 Nov. 25, 2004

(51) Int. Cl.
*A47L 13/02* (2006.01)

(52) U.S. Cl. ..... 15/236.06; 15/236.05; 15/236.07; 15/236.08; D32/46

(58) Field of Classification Search ..... 15/236.01, 15/236.04, 236.05, 236.06, 236.07, 236.08, 15/236.09; 30/169, 172–173; 56/400.21, 56/400.16, 400.17; D32/46, 49
See application file for complete search history.

(56) References Cited

U.S. PATENT DOCUMENTS 84,587 A * 12/1868 Sloat ..... 15/104.04
669,353 A * 3/1901 Shurman ..... 452/103
1,223,064 A * 4/1917 Meader ..... 15/104.011
1,241,779 A * 10/1917 Suydam ..... 15/236.08
4,305,175 A * 12/1981 Burgess, Jr. ..... 15/236.02
4,667,362 A * 5/1987 Mattingly ..... 15/236.08
5,309,598 A 5/1994 Carpenter
5,373,600 A * 12/1994 Stojanovski et al. ..... 15/111
5,396,704 A * 3/1995 Fiala et al. ..... 30/299
6,243,910 B1 * 6/2001 Diehl ..... 15/236.06
6,772,466 B1 * 8/2004 Ziegler ..... 15/160

FOREIGN PATENT DOCUMENTS

GB 2355202 4/2001

* cited by examiner

*Primary Examiner*—Richard Crispino
*Assistant Examiner*—Laura Guidotti
(74) *Attorney, Agent, or Firm*—O. M. (Sam) Zaghmout; Bio Intellectual Property Services (Bio IPS) LLC

(57) ABSTRACT

As shown in FIG. 1, there is a paint scraper 1, comprising support means 2 supporting a blade portion 3, the blade portion having a scraping edge 5 with undulations, the undulations being arranged to match corrugations of a sheet of corrugated iron; the scraper 1 being formed such that when it is in use the blade portion can be arranged against the sheet of corrugated iron such that the blade portion extends from the sheet in a substantially perpendicular fashion with the undulations of the scraping edge 5 aligned in complimentary fashion with undulations of the sheet, and wherein a substantial part of the scraping edge can then be scraped across the sheet to substantially effectively remove paint flakes or dirt from the sheet.

6 Claims, 3 Drawing Sheets

SCRAPER

FIELD OF INVENTION

This invention relates to a scraper

BACKGROUND ART

It is known to use scrapers to remove flaking paint or the like from walls, roofs, or other surfaces prior to painting. A problem with such scrapers is that they usually have a flat straight edged blade, which makes it inconvenient to use them with corrugated iron surfaces or the like. This is because the blade is only able to contact a relatively minor portion of the surface across the corrugations at any one time. It is accordingly an object of the present invention to go at least some way towards addressing this problem, or to at least provide the public with a useful choice.

The term "comprise", "comprises", "comprised" or "comprising", if and when used in this document, should be interpreted non-exclusively, i.e. should be interpreted to mean "consisting of or including".

GENERAL DESCRIPTION

According to one aspect of the invention there is provided a scraper, comprising support means, a first blade portion having a first undulating scraping edge, and a second blade portion having a second undulating scraping edge, the first and second scraping edges being held in spaced relationship such that undulations of the first scraping edge substantially align with undulations of the second scraping edge; the scraper being formed such that when it is in use at least a substantial portion of each scraping edge can be caused to simultaneously contact and scrape across a corrugated surface.

Preferably the first and second blade portions, including the first and second scraping edges, are substantially planar.

Preferably the undulations of each scraping edge are substantially curved from beginning to end. Alternatively the undulations may be made up from a series of straight edges angled (for example at 90 degrees) with respect to one another.

Preferably the first and second blade portions are substantially parallel with respect to one another.

Preferably the support means comprises a base from which the first and second blade portions protrude.

Preferably the support means incorporates a handle fitting to enable a handle to be fitted to the support means.

According to another aspect of the invention there is provided a scraper, comprising support means and a blade portion, the blade portion being substantially planar and incorporating an undulating scraping edge; the scraper being formed such that when it is in use a substantial part of the undulating scraping edge can be scraped across a corrugated surface to remove paint or dirt from the surface.

Preferably the undulations are substantially curved from beginning to end.

DESCRIPTION OF DRAWINGS

Some preferred forms of the invention will now be described by way of example, and with reference to the accompanying drawings, of which.

DETAILED DESCRIPTION

Figure 1:
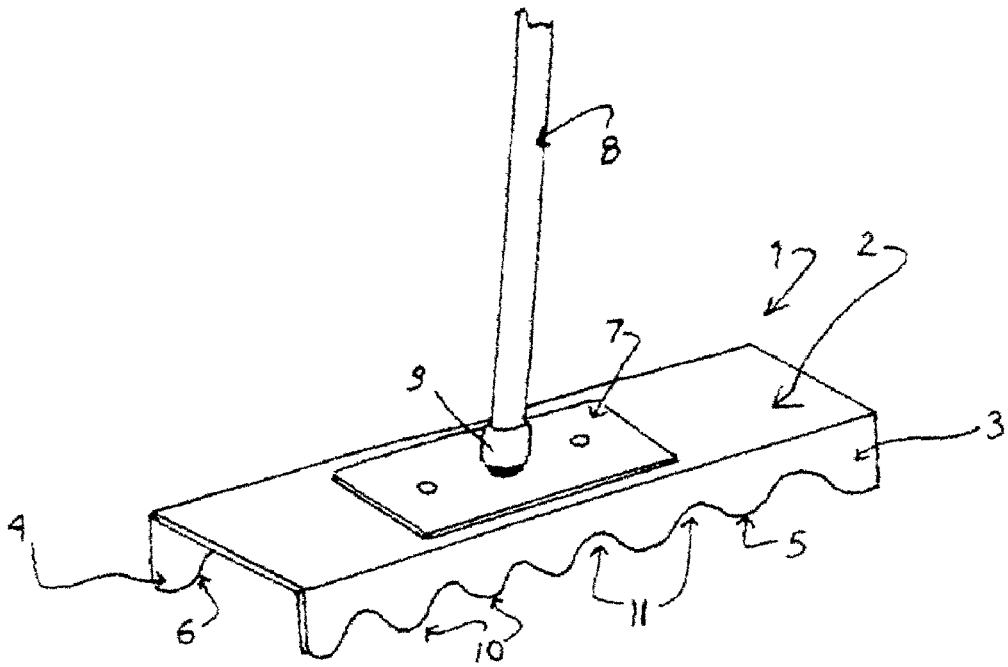
FIG. 1 is a perspective view of a paint scraper.
Figure 2:
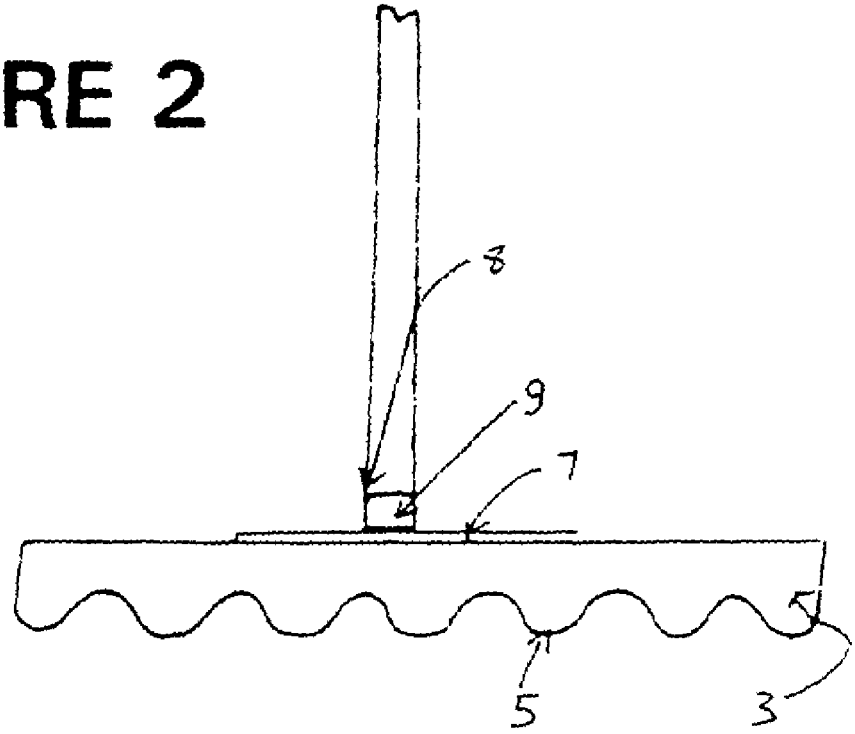
FIG. 2 is a side view of the scraper of FIG. 1.
Figure 3:
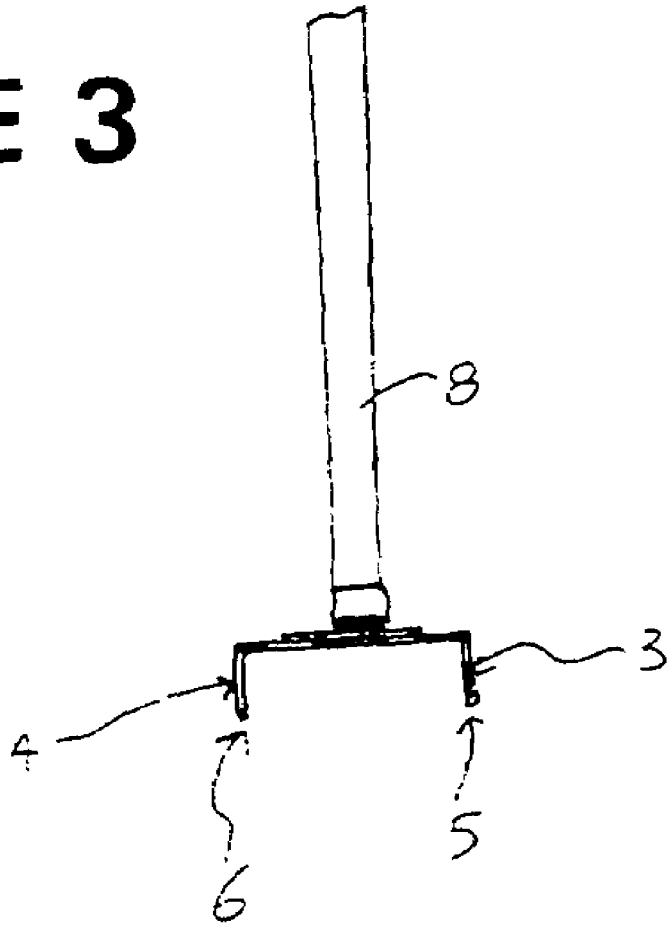
FIG. 3 is an end view of the scraper of FIGS. 1 and 2.

Referring to FIGS. 1, 2 and 3, the scraper 1 has a support means incorporating a rectangular plate 2. Planar blade portions 3 and 4 extend downwards at right angles from opposite sides of the plate 2, and each blade portion is of substantially the same size and shape. The blade portions 3 and 4 each have an undulating scraping edge 5 and 6 respectively, and the undulations correspond in shape to the transverse cross section of a sheet of corrugated roofing or fencing iron.

The scraper 1 has a fitting 7 on the plate 2 for receiving a pole 8. The fitting may or may not include a pivot connection 9 to enable the pole to pivot with respect to the plate 2. It is however desirable that the pole 8 be able to pivot so as to optimise the performance of the scraper 1.

When the scraper 1 is in use a worker may place it on a length of corrugated iron with the scraping edges 5 and 6 contacting the iron substantially at right angles. The arrangement is such that ridges 10 of the undulations substantially match and can ride along depressions in the corrugations of the iron, and depressions 11 of the undulations substantially match and can ride along ridges in the corrugations of the iron. The worker then grips the pole 8 and uses this to push or pull the scraper along the corrugated iron to clean it and to remove loose flakes of paint. The pivot connection 9 enables the scraping edges 5 and 6 to remain in contact with the iron even if the angle of the pole 8 with respect to the iron is altered.

The scraping edges undulate to the extent that they can accommodate a plurality of corrugations in the iron, and thus with one stroke of the scraper a good number of the corrugations can be worked on simultaneously. Additionally, the use of two spaced scraping edges 5 and 6 means that with each stroke of the scraper the corrugations in the iron receive a double working. In some embodiments of the invention there may be more than two blade portions and scraping edges so that each stroke of the scraper gives the iron more than a double working.

In some embodiments of the invention the handle 8, and or the fitting 7, may be detachable from the plate 2. In such embodiments the arrangement may be such that a paint roller extension handle can be easily fitted to the plate 2 and subsequently detached.

In further embodiments of the invention there may be only one blade portion, and thus only one associated scraping edge. In such embodiments there may or may not be a wheel or other guides extending downwards from the plate 2 to keep the blade portion correctly aligned with respect to a corrugated surface when in use.

In further embodiments of the invention the undulations in the scraping edge or edges may be other than curved—ie for use with corrugated surfaces in which the corrugations are made up of straight edges.

While some preferred forms of the invention have been described by way of example, it should be appreciated that improvements and modifications can occur without departing from the scope of the following claims.

The invention claimed is:

1. A paint scraper, comprising support means supporting a blade portion, the blade portion having a scraping edge with undulations, the undulations being in the form of a substantially evenly continuously curved sine wave arranged to match corrugations of a sheet of corrugated iron; the scraper being formed such that when it is in use the blade portion can be arranged against the sheet of corrugated iron such that the blade portion extends from the sheet in a substantially perpendicular fashion with the undulations of the scraping edge aligned in complimentary fashion with undulations of the sheet, and wherein a substantial part of the scraping edge can then be scraped across the sheet to substantially effectively remove paint flakes or dirt from the sheet; the scraper being such that the blade portion is substantially planar, and wherein there is a second blade portion substantially the same as the first blade portion, each blade portion being supported by the support means in substantially parallel relationship such that the undulations corresponding to each blade portion are substantially aligned.

2. A scraper according to claim 1, wherein the support means comprises a base from which the portions extend.

3. A scraper according to claim 1, wherein the support means incorporates a handle fitting to enable a handle to be fitted to the support means.

4. A scraper according to claim 1, comprising a handle fitting which enables a handle to pivot.

5. A scraper according to claim 1, comprising a handle fitting which enables a handle to pivot, and wherein the handle comprises a pole.

6. A scraper according to claim 1, is substantially planar, and wherein there is a second blade portion substantially the same as the first blade portion, each blade portion being supported by the support means in substantially parallel relationship such that the undulations corresponding to each wherein the support means incorporates a handle fitting to enable a handle to be fitted to the support means, and wherein the handle fitting enables the handle to pivot when the handle comprises a pole.

* * * * *